US008629351B2

(12) United States Patent
Asplund et al.

(10) Patent No.: US 8,629,351 B2
(45) Date of Patent: Jan. 14, 2014

(54) DC CABLE FOR HIGH VOLTAGES

(75) Inventors: Gunnar Asplund, Solna (SE); Björn Jacobson, Grängesberg (SE)

(73) Assignee: ABB Technology AG (CH)

( * ) Notice: Subject to any disclaimer, the term of this patent is extended or adjusted under 35 U.S.C. 154(b) by 174 days.

(21) Appl. No.: 13/163,445

(22) Filed: Jun. 17, 2011

(65) Prior Publication Data

US 2011/0278041 A1 Nov. 17, 2011

Related U.S. Application Data

(63) Continuation of application No. PCT/EP2008/067742, filed on Dec. 17, 2008.

(51) Int. Cl.
*H01B 7/00* (2006.01)

(52) U.S. Cl.
USPC ..... 174/102 R; 174/102 SP; 174/105 R; 174/105 B; 174/110 R; 174/112

(58) Field of Classification Search
USPC ..... 174/36, 110 R, 114 R, 114 S, 115, 116, 174/102 R, 113 R, 108, 109
See application file for complete search history.

(56) References Cited

U.S. PATENT DOCUMENTS

| | | | | |
|---|---|---|---|---|
| 2,796,463 | A * | 6/1957 | Mallinckrodt | 178/45 |
| 3,088,995 | A | 5/1963 | Baldwin | |
| 3,312,774 | A * | 4/1967 | Drinko et al. | 174/120 SC |
| 4,129,841 | A * | 12/1978 | Hildebrand et al. | 333/237 |
| 5,473,336 | A * | 12/1995 | Harman et al. | 343/790 |
| 5,481,070 | A | 1/1996 | Hirose et al. | |
| 6,509,527 | B2 | 1/2003 | Gadessaud et al. | |
| 8,119,907 | B1 * | 2/2012 | McNutt | 174/36 |
| 8,183,462 | B2 * | 5/2012 | Nordin et al. | 174/102 R |
| 8,217,267 | B2 * | 7/2012 | Nordin et al. | 174/102 R |
| 2006/0048961 | A1 * | 3/2006 | Pfeiler et al. | 174/36 |
| 2007/0037419 | A1 * | 2/2007 | Sparrowhawk | 439/98 |

FOREIGN PATENT DOCUMENTS

| | | |
|---|---|---|
| DE | 357599 C | 8/1922 |
| EP | 0868002 B1 | 12/2008 |

OTHER PUBLICATIONS

International Preliminary Report on Patentability; PCT/EP2008/067742; Dec. 8, 2010; 10 pages.
International Search Report and Written Opinion of the International Searching Authority; PCT/EP2008/067742; Jul. 8, 2009; 14 pages.

* cited by examiner

*Primary Examiner* — William H Mayo, III
(74) *Attorney, Agent, or Firm* — St. Onge Steward Johnston & Reens LLC

(57) ABSTRACT

A DC cable for high voltages having at least an inner conductor surrounded by an insulating layer configured to take the voltage to be taken between the conductor and the surroundings of the cable. The insulating layer is formed by a plurality of superimposed film-like layers of insulating material each having isolated areas of metal on top thereof. The metal areas of consecutive such film-like layers are at least partially overlapping each other as seen in the radial direction of the cable so as to create a large number of small capacitors in said insulating layer of the cable.

20 Claims, 3 Drawing Sheets

DC CABLE FOR HIGH VOLTAGES

CROSS-REFERENCE TO RELATED APPLICATIONS

The present application is a continuation of pending International patent application PCT/EP2008/067742 filed on Dec. 17, 2008 which designates the United States and the content of which is incorporated herein by reference.

FIELD OF THE INVENTION

The present invention relates to a DC cable for high voltages having at least an inner conductor surrounded by an insulating layer configured to take the voltage to be taken between the conductor and the surroundings of the cable.

BACKGROUND OF THE INVENTION

"High voltages" means a voltage level of at least 10 kilovolts (kV), but often much higher, such as hundreds of kV. This voltage has to be taken by the insulating layer, since the conductor of the cable is on high voltage potential and the periphery of the cable has to be on earth potential, and said insulating layer is for that sake normally surrounded by a semiconducting thin shielding layer. This causes dielectric stress upon the insulating layer, which has to be dimensioned for reliably taking this stress.

Furthermore, when transmitting electric power through High Voltage Direct Current (HVDC) the losses are reduced when the voltage is increased, so that it is for that reason a desire to increase said voltage.

For illuminating, but not in any way restricting the present invention, the use of a cable of this type for HVDC transmission is very schematically illustrated in FIG. 1. A plant for transmitting electric power shown there has a direct voltage network 1 for HVDC having two said cables 2, 3 for interconnecting two stations 4, 5, which are configured to transmit electric power between the direct voltage network 1 and an alternating voltage network 6, 7 here having three phases and connected to the respective station. One 2 of the cables is intended to be on positive potential of half the direct voltage of the direct voltage network, while the other cable 3 is on negative potential of half of the direct voltage. Accordingly, this plant has a bipolar direct voltage network, but a monopolar network with a return current flowing through earth electrodes is also conceivable.

There is a need for transmitting more power than possible today in HVDC transmissions, but cables for higher power than 800 MW are still not developed. Should this be done without increasing the dimensions of the cable, which already today are impressive and close to transport limits, either the current has to be increased by conductors with higher conductivity or the voltage has to be increased by higher stress to said insulating layer. The conductivity of the conductor is limited by the conductor material, copper and aluminium, which cannot be improved and other conductors are not available within the foreseeable future or are far too expensive (superconductors) for constituting any real option. Thus, the other way to increase the power in such transmissions is by improving the insulating material, which seems to be the most promising way to substantially increase the power and is also favourable owing to the reduction of losses obtained by increasing the voltage.

There are two known types of HVDC cables, mass impregnated cables (thick insulating layer normally formed by a paper impregnated by oil) and extruded cables (insulating layers on polymer base). The average electric field acceptable for these cables (for the mass impregnated cables) is around 30 kV per millimeter and for the extruded cables around 20 kV per millimeter. The mass impregnated cables may be improved by exchanging some or all of the paper by a plastic film, but that would make the impregnation more difficult. Moreover, the extruded cables have probably still potential to have increased field by utilising improved materials, in which one goal is to double the dielectric stress to 40 kV per millimeter. Appended FIG. 2 shows a known extruded cable having an inner conductor 8 surrounded by a thin semiconducting layer 9 having potential equalizing properties, a thick insulating layer 10 of polymer base, such as cross-linked polyethylene outside thereof and an outer thin semiconducting shielding layer 11 also being potential equalizing. Such a cable is also known through EP 0 868 002.

U.S. Pat. No. 6,509,527 discloses a use of a cable insulating layer making it possible to increase the dielectric stress to a cable of this type.

Both technologies described above for producing a DC cable have a design criteria that dielectric faults shall not occur during the lifetime of the cable, which is 40 years. This puts very stringent requirements on reliability of the design and the voltage stress has to be much lower than it would be if more frequent failures were accepted.

SUMMARY OF THE INVENTION

The object of the present invention is to provide a DC cable for high voltages having an insulating layer with an increased acceptable dielectric stress and by that enabling an increase of said voltage level without increasing the dimensions of the cable with respect to such cables already known.

This object is obtained by providing such a cable in which said insulating layer is formed by a plurality of superimposed film-like layers of insulating material each having isolated areas of metal on top thereof, and in which said metal areas of consecutive such film-like layers are at least partially overlapping each other as seen in the radial direction of the cable so as to create a large number of small capacitors in said insulating layer of the cable.

Such a construction of said insulating layer makes it possible to accept dielectric stresses to said insulating layer of at least 50 kV per millimeter, such as 50-150 kV per millimeter and well 100-150 kV/millimeter or possibly even higher. The explanation to this emanates from the properties of the DC capacitor technology, and the present invention is based on the understanding that this technology may be used for improving DC cables. DC capacitors are manufactured while using plastic film that is partially covered with a very thin layer of metal to form electrodes. This design accepts faults as the fault is kept within a very small volume. This is due to the shielding effect of the electrodes plus the fact that the fault energy also fuses away the metal layer and creates an insulating area around the fault. This means that thousands of faults can be accepted without affecting the function of the capacitor itself. Design values for DC capacitors are typically 200 kV per millimeter. The idea of the present invention is to use this technology for producing a cable with an insulating layer accepting single faults contrary to such cables already known making it possible to substantially increase the dielectric stress upon the insulating layer thereon without jeopardizing proper function of the cable during the entire lifetime thereof. By using said metal areas a fault in a said film-like layer will not give rise to high fields in the surroundings as would a fault in a film-like layer that is not metallised. The reason is that the cable is built up by a large number of small capacitors that will keep the voltage stable irrespectively of faults within one film-like layer. Looking at just the fault area itself, there is no difference whether it is a DC cable or a DC capacitor. Thus, the metal area will spread out the electric field, so that a local fault will not propagate through the next film-like layer.

Thus, the present invention makes it possible to increase the voltage and by that the electric power transmitted through a DC cable of a certain thickness, but it would also be possible and in some application interesting to make a DC cable for a certain electric power thinner than possible before.

According to an embodiment of the invention the number of superimposed said film-like layers of said insulating layer is greater than (>) 100 or >500 or >1 000, such as 200-10 000. Accordingly, said film-like layer has to be very thin, such as 0.5-100 μm or 1-20 μm or 1-10 μm, as in another embodiment of the invention, so that a high number of small capacitors will be formed through the thickness of said insulating layer and a high reliability of the operation thereof is obtained in spite of faults occurring within one or some film-like layers thereof.

According to another embodiment of the invention, each said metal area has a thickness of less than or equal to (≤)200 nm, ≤100 nm, 1 nm-50 nm or 1-10 atom layers. Accordingly, the thickness of the metal areas is negligible with respect to the thickness of a film-like layer, so that the film-like layers may be arranged tightly upon each other in spite of the existence of said metal areas and the thickness of the insulating layer will be substantially totally formed by insulating material. Thus, it is in fact well possible that the metal areas have a thickness of only a few atom layers.

According to another embodiment of the invention, the thickness of said metal areas is less than or equal to (≤) 1/5, 1/10 or 1/50 of the thickness of the respective said film-like layer. These proportions or even larger differences between the thickness of the film-like layer and the thickness of the metal areas are possible depending upon the thickness of the film-like layer chosen.

According to another embodiment of the invention, each said metal area has an area being less than or equal to (≤) 10 $cm^2$ or 1 $mm^2$-5 $cm^2$. These are suitable areas of such isolated metal areas, in which 1 $cm^2$ would be a typically suitable area thereof.

According to another embodiment of the invention, said metal areas form islands on the respective said film-like layer with a distance between adjacent such islands being substantially the same or less than the width of such an island, such as 0.1-1 time said width. These are suitable distances separating adjacent said metal areas for obtaining a suitable large number of said small capacitors in said insulating layer for allowing the higher dielectric stress thereon aimed at.

According to another embodiment of the invention, said metal areas of two consecutive film-like layers are mutually displaced as seen in the radial direction of the cable. By arranging said metal areas with such a displacement each risk of a short circuit propagating through the thickness of the cable upon occurrence of a fault is efficiently eliminated.

According to another embodiment of the invention, said insulating layer is formed by a web of a plastic film with isolated metallised areas wound in a plurality of superimposed layers around said conductor of the cable, which is a suitable way of having a cable according to the invention realised.

According to another embodiment of the invention said plastic film web is wound without overlaps of film turns arranged next to each other with respect to the longitudinal direction of the cable. By such a precision winding of said turns without overlaps and with tight tolerances on the edge to edge distance any wedges in the wound insulation with risk of electric field concentrations may be eliminated.

According to another embodiment of the invention, said film web is wound with a partial overlap of consecutive turns of the film web with respect to the longitudinal direction of the cable, and voids created at the edge of a film part being overlapped are filled with a gel-like insulating material. By doing this said precision winding may be omitted and problems of high fields in wedges connected to air voids may be solved.

According to another embodiment of the invention, said film web is wound with a partial overlap of consecutive turns of the film web with respect to the longitudinal direction of the cable, and lateral outer edges of the film web wound are chamfered and consecutive film turns as seen in the longitudinal direction of the cable are overlapped while bearing tightly against each other. This is another way of avoiding a requirement of precision winding for avoiding the problems with voids.

The invention also relates to a method for producing a DC cable for high voltages, which is characterized by the step of winding a film-like web of insulating material having isolated areas of metal on top thereof in a plurality of superimposed layers around a conductor so that said metal areas of consecutive such film-like layers are at least partially overlapping each other as seen in the radial direction of the cable so as to create a large number of small capacitors in said insulating layer of the cable. A DC cable with a high dielectric stress allowed may be obtained by means of this method.

The invention also relates to a use of a cable according to the invention for transmitting electric power, such as 500-1, 500 MW, 800-1,500 megawatts (MW) or 800-1,200 MW, in the form of High Voltage Direct Current there through. The use of a cable according to the invention for transmitting such high powers will be advantageous, since it does not necessitate any exaggerated dimensions of the cable. This is also applicable for a use of a cable according to the invention for transmission of electric power, in which said voltage is 10 kV-1,500 kV, 100 kV-1,500 kV, 400 kV-1,500 kV or 800 kV-1,500 kV. Said electric power is then advantageously transmitted by a current of 500 A-7 kA, 1 kA-7 kA, or 2 kA-5 kA flowing in said cable.

Further advantages as well as advantageous features of the invention will appear from the following description.

BRIEF DESCRIPTION OF THE DRAWINGS

With reference to the appended drawings, below follows a description of embodiments of the invention cited as examples.

DETAILED DESCRIPTION OF THE INVENTION

Figure 1:
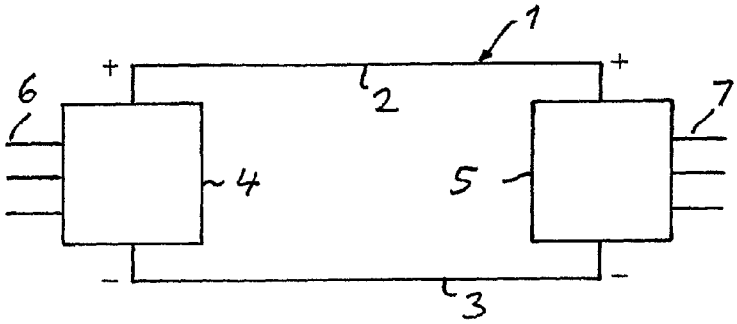
Fig 1 (PRIOR ART)
FIG. 1 is a schematic block diagram illustrating a plant in which a cable according to the invention may be used.
Figure 2:
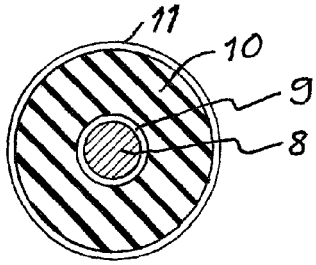
FIG. 2 is a simplified cross-section showing an embodiment of a high voltage DC cable of the invention.
Figure 3:
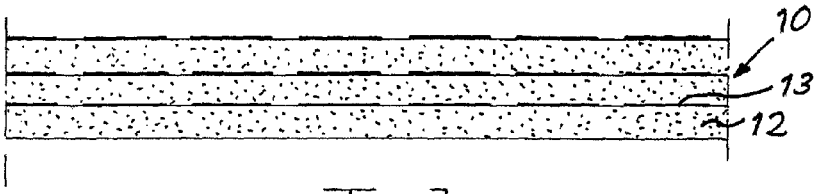
FIG. 3 is a simplified cross-section view of a part of the insulating layer of a DC cable according to the present invention.

A small region of an insulating layer 10 of a DC cable according to an embodiment of the present invention is shown in FIG. 3. The insulating layer is formed by a high amount, such as 200-10,000, layers 12 of a metallised plastic film wound on top of each other. The plastic film is made of a material with appropriate insulating properties, such as cross-linked polyethylene, and has here a thickness in the order of 1-10 μm. The metallisation is achieved by isolated metal areas 13 with a thickness being negligible with respect to the thickness of the plastic film, and the thickness of these metal areas has been strongly exaggerated in the figures for making it possible to see them at all. Thus, the thickness of these metal areas may be as small as a few atom layers. These metal areas have typically an area in the order of 1 $cm^2$ and the distance therebetween is equal to or less than the width of these areas. These areas may have any shape as seen in the direction perpendicularly to the film surface and is in this embodiment (see FIG. 5) rectangular. Thanks to the relationship of the thicknesses of the plastic film layer 12 and of the metal areas 13 consecutive plastic film layers will bear tightly upon each other.

A large number of small capacitors are in this way formed inside the insulating layer. This means that the electric field inside the insulating layer will be substantially uniformly distributed inside the insulating layer.

Figure 4:
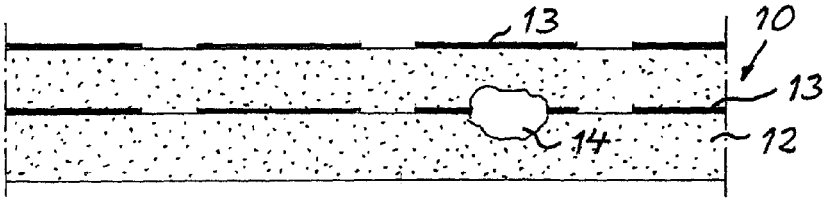
FIG. 4 is a view corresponding to FIG. 3 showing the occurrence of a local fault in said insulating layer.

FIG. 4 shows what will happen if a fault occurs on a spot 14 in the insulating layer. The design of the insulating layer will keep the fault within a very small volume, and the fault energy will fuse away the metal layer at the fault spot 14 creating a hole in the metal area in question, so that an insulated area will be created around the fault. This means that a number of faults may in fact be accepted within a restricted length, such as one meter, of the cable without affecting the well function of the insulating layer of the cable.

Figure 5:
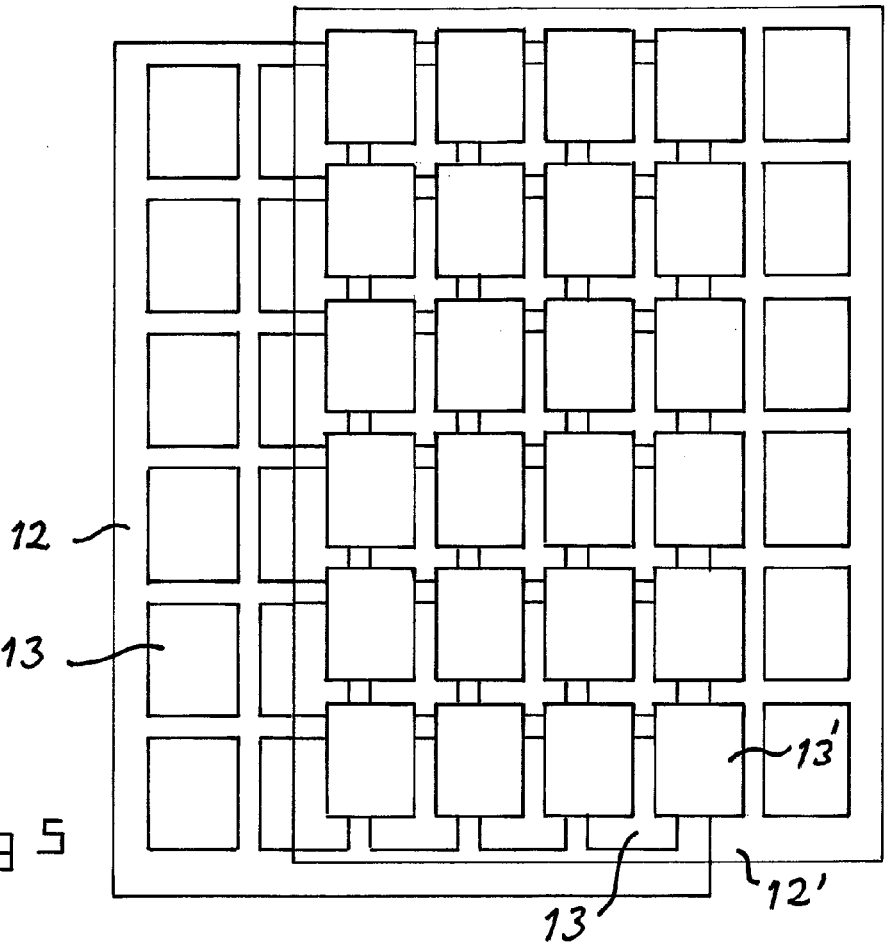
FIG. 5 is a simplified view in the radial direction of a DC cable according to the invention showing a part of two superimposed film-like layers of the insulating layer thereof.

FIG. 5 illustrates how two plastic film layers 12, 12' are preferably superimposed so that the metal areas 13, 13' thereof are mutually displaced as seen in the radial direction of the cable. By doing this each risk of a short circuit through the cable isolation as a consequence of a fault is eliminated.

Figure 6:
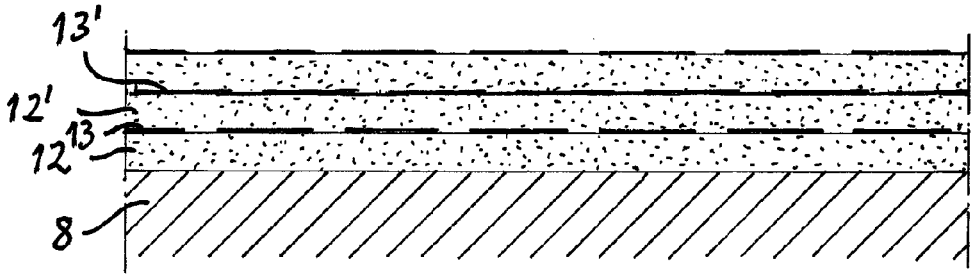
FIG. 6 is a view corresponding to FIG. 3 of a cable in which the film-like layers of the insulating layer thereof are wound according to FIG. 5.

FIG. 6 shows a cross-section of a part of a cable designed according to FIG. 5, in which also the inner conductor 8 is indicated.

Although the insulating layer of a DC cable designed in this way has a similar function as a DC capacitor there are some differences. One difference is that in a capacitor charging currents have to be moved in and out of the capacitor, which is not the case in a cable making it easier in this respect with a cable design. However, another difference is that a capacitor has all plastic films or foils stacked together, which makes it easier with a capacitor as no termination problems occur.

Figure 7:
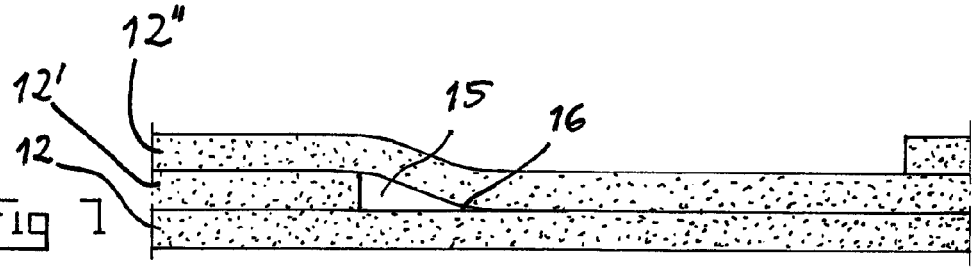
FIG. 7 is a simplified view illustrating how voids are created when film-like layers in said insulating layer are wound with overlaps.

FIG. 7 shows what happens when a plastic film web, possibly with a width of approximately 20 mm and a thickness of 5 μm, is wound in superimposed layers 12, 12' and 12" with overlaps of film turns arranged next to each other with respect to the longitudinal direction of the cable. This may result in air voids 15 in the wedge 16 resulting in the overlap region.

One way of addressing the problem with creation of such voids would be to use very thin plastic films that make the voids so thin that the widthstand thereof will be sufficient according to the Paschen Law. Calculations have shown that plastic films being thinner than 5 μm would be sufficient to reach a voltage strength of 200 kV per millimeter.

Figure 8:
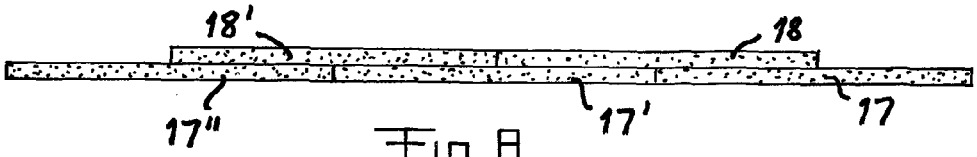
FIG. 8 is a view corresponding to FIG. 7 illustrating precision winding of said film-like layers.

However, there is also other ways of addressing the problem with such voids, one of which is shown in FIG. 8 and constitutes of precision winding of plastic film webs 17, 17', 17", 18, 18' without overlaps and with a tight tolerance on edge to edge distance.

Figure 9:
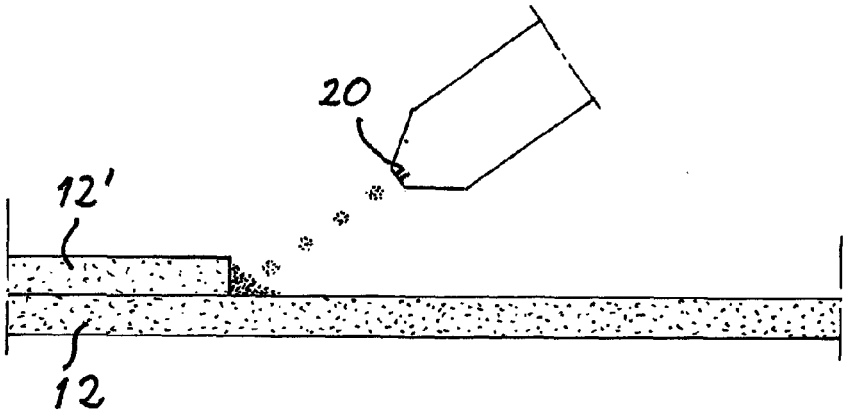
FIGS. 9 and 10 are views illustrating how a void illustrated in FIG. 7 may be filled with a gel-like material.
Figure 10:
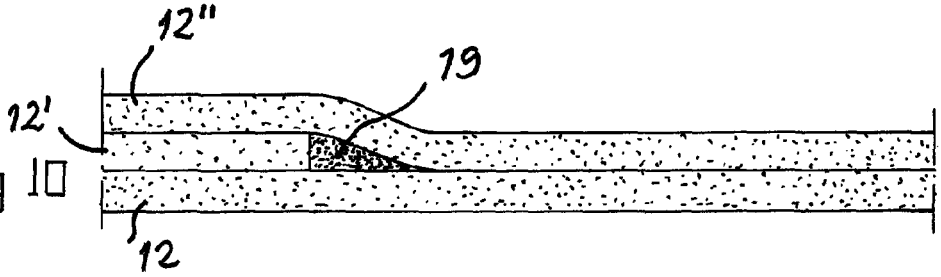

FIGS. 9 and 10 shows another alternative allowing the creation of an overlap during the winding process as shown in FIG. 7. The voids are in this case filled with a gel-like, accordingly semi-liquid, insulating material 19 during the winding process while using the same technology as is used in inkjet printers, wherein the "inkjet" is coming from a nozzle 20 schematically indicated. The idea is that the volume of gel should be bigger than the void in order to avoid the risk of getting new voids.

Figure 11:
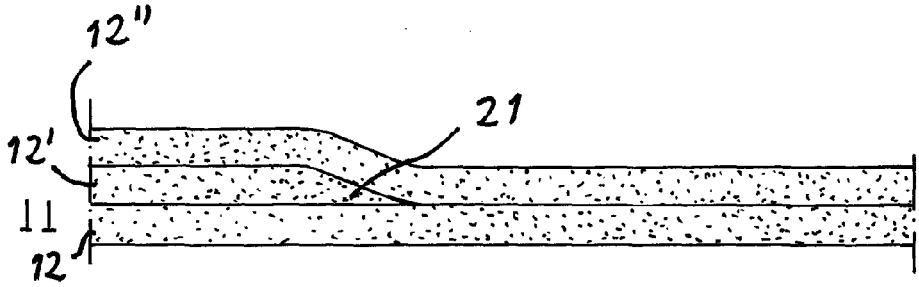
FIG. 11 is a view corresponding to FIG. 7 illustrating an alternative way of avoiding voids filled with air when winding said film-like layers with overlaps.

FIG. 11 shows another possibility to avoid problems with voids by mechanically forming the plastic film web edges before winding so no voids occur, which is here done by providing the lateral edges of said film webs with a chamfer 21, accordingly by mechanically "sharpening" these edges before winding, so that the film-like layers will bear tightly against each other also in the overlap region.

The invention is of course not in any way restricted to the embodiments described above, but many possibilities to modifications thereof would be apparent to a person with ordinary skill in the art without departing from the scope of the invention as defined in the appended claims.

What is claimed is:

1. A DC cable for high voltages comprising:

at least one inner conductor surrounded by an insulating layer configured to take the voltage taken between the conductor and the surroundings of the cable, wherein said insulating layer is formed by a plurality of superimposed film-like layers of insulating material, wherein said film-like layers of insulating material each have isolated areas of metal on top of them, wherein the thickness of said metal areas is less than the thickness of said film-like layer;

wherein said metal areas of consecutive such film-like layers are at least partially overlapping each other as seen in the radial direction of the cable so as to create a large number of small capacitors in said insulating layer of the cable, and wherein said metal areas of two consecutive film-like layers are mutually displaced in said radial direction of the cable.

2. The cable of claim 1, wherein the number of superimposed said film-like layers of said insulating layer is greater than 100.

3. The cable of claim 1, wherein the thickness of each said film-like layer is in the range of 0.5-100 μm.

4. The cable of claim 1, wherein each said metal area has a thickness less than or equal to 200 nm.

5. The cable of claim 1, wherein the thickness of said metal areas is less than or equal to ⅕, of the respective said film-like layer.

6. The cable of claim 1, wherein each said metal area has an area being less than or equal to 10 $cm^2$.

7. The cable of claim 1, wherein said metal areas form islands on the respective said film-like layer with a distance between adjacent such islands being substantially the same or less than the width of such an island.

8. The cable of claim 1, wherein said insulating layer is formed by a web of a plastic film with isolated metallised areas wound in a plurality of superimposed layers around said conductor of the cable.

9. The cable of claim 8, wherein said web is wound without overlaps of film turns arranged next to each other with respect to the longitudinal direction of the cable.

10. The cable of claim 8, wherein said web is wound with a partial overlap of consecutive turns of the film web with respect to the longitudinal direction of the cable, and that voids created at the edge of a film part being overlapped are filled with a gel-like insulating material.

11. The cable of claim 8, wherein said web is wound with a partial overlap of consecutive turns of the web with respect to the longitudinal direction of the cable, wherein the lateral outer edges of the web wound are chamfered and wherein consecutive film turns as seen in the longitudinal direction of the cable are overlapped while bearing tightly against each other.

12. The cable of claim 1, wherein each said metal area has a thickness in the range of 1 nm-50 nm.

13. The cable of claim 1, wherein each said metal area has an area ranging from 1 $mm^2$-5 $cm^2$.

14. The cable of claim 1, wherein said metal areas form islands on the respective said film-like layer with a distance between adjacent such islands being 0.1-1 times said width.

15. The cable of claim 1, wherein each said metal area has a thickness in the range of 1-10 atom layers.

16. A method for producing a DC cable for high voltages, comprising:

winding a film-like web of insulating material having isolated areas of metal on top thereof in a plurality of superimposed layers around a conductor so that said metal areas of consecutive such film-like layers are at least partially overlapping each other as seen in the radial direction of the cable so as to create a large number of small capacitors in said insulating layer of the cable and so said metal areas of two consecutive film-like layers are mutually displaced as seen in said radial direction of the cable;

wherein the thickness of said metal areas is less than the thickness of said film-like layer.

17. A method for transmitting electric power comprising:

providing a cable having at least one inner conductor surrounded by an insulating layer, configured to take the voltage taken between the conductor and the surroundings of the cable, wherein said insulating layer is formed by a plurality of superimposed film-like layers of insulating material, wherein said film-like layers of insulating material each have isolated areas of metal on top of them, wherein said metal areas of consecutive such film-like layers are at least partially overlapping each other as seen in the radial direction of the cable so as to create a large number of small capacitors in said insulating layer of the cable, and wherein that said metal areas of two consecutive film-like layers are mutually displaced in said radial direction of the cable, wherein the thickness of said metal areas is less than the thickness of said film-like layer;

and transmitting power ranging from 500 to 1500 megawatts (MW), in the form of High Voltage Direct Current there through.

18. The method of claim 17, wherein the voltage in the cable ranges from 10 kilovolts to 1500 kilovolts.

19. The method of claim 17, wherein said electric power is transmitted by a current ranging from 500 amperes to 7 kiloamperes flowing in said cable.

20. The method of claim 18, wherein said electric power is transmitted by a current ranging from 500 amperes to 7 kiloamperes flowing in said cable.

* * * * *